United States Patent [19]

Hinrichsen

[11] 4,082,248

[45] Apr. 4, 1978

[54] PIPE DRIVING APPARATUS

[75] Inventor: Gerhard Hinrichsen, Munich, Germany

[73] Assignee: Gewerkschaft Eisenhutte Westfalia, Westfalia, Germany

[21] Appl. No.: 388,507

[22] Filed: Aug. 15, 1973

[30] Foreign Application Priority Data

Aug. 24, 1972 Germany ..... 2241695

[51] Int. Cl.[2] ..... E01G 3/02

[52] U.S. Cl. ..... 254/29 R

[58] Field of Search ..... 254/29 R; 61/42, 85, 61/72.7; 72/370; 29/334, 337

[56] References Cited

U.S. PATENT DOCUMENTS

| | | | |
|---|---|---|---|
| 3,005,314 | 10/1961 | Cunningham | 254/29 R |
| 3,233,315 | 2/1966 | Levake | 254/29 R |
| 3,762,174 | 10/1973 | Fikse et al. | 61/72.7 |
| 3,807,509 | 4/1974 | Linsay | 254/29 R X |
| 3,817,079 | 6/1974 | Priester | 72/370 |

FOREIGN PATENT DOCUMENTS

| | | | |
|---|---|---|---|
| 1,335,954 | 7/1963 | France | 61/72.7 |
| 325,175 | 2/1930 | United Kingdom | 61/72.7 |

*Primary Examiner*—Robert C. Watson

*Attorney, Agent, or Firm*—Lowe, King, Price & Markva

[57] ABSTRACT

A pipe-driving apparatus has a support body with tubular components for accommodating the cylinders of hydraulic rams. The body has a plurality of location members with jaws selectively engageable with the outer end of a pipe section to be driven.

These jaws can move radially inwards or outwards of the pipe section and can thus selectively couple the support body to the pipe-section so that the rams can be extended against an abutment to move the pipe section longitudinally.

During use of the apparatus the support body and the cylinders of the rams are substantially entirely located within the pipe section.

3 Claims, 6 Drawing Figures

PIPE DRIVING APPARATUS

BACKGROUND OF THE INVENTION

The present invention relates to a method of and an apparatus for driving pipes or the like tubular structures into the ground.

In the construction of tunnels, pipe lines, conduits and the like, used particularly for accommodating public utilities, it is known to drive a series of pipe sections into the ground in a direction longitudinally of the pipe sections. Usually an open trench is formed which accommodates the pipe-driving apparatus which drives each of the pipe sections in succession through one wall of the trench. The material which accumulates within the pipe sections can be removed manually or by mechanical means located within the pipe sections.

In known forms of pipe-driving apparatus a series of hydraulic piston and cylinder units or rams engage on an abutment at a wall of the trench opposite the pipe sections and the rams are connected to a thrust ring engageable on the end of the pipe section to be driven in. The thrust ring is usually guided for sliding within the trench. This apparatus and its method of operation require a trench of comparatively great length equal to at least the combined length of one of the pipe sections the length of the rams when in a fully retracted state and the appropriate dimensions of the thrust ring and abutment. A long trench is rather costly to excavate and in some cases there is insufficient space to form such a trench.

Other forms of apparatus, such as is described in our U.K. Pat. Specification 1202304, have been designed to overcome this problem. A disadvantage of this earlier apparatus is that it requires a special framework and the manual relocation of the rams is time consuming.

A general object of the present invention is to provide an improved method of and apparatus for driving pipes.

SUMMARY OF THE INVENTION

According to the present invention there is provided a pipe-driving apparatus comprising a plurality of hydraulic rams having a sufficient amount of thrust force to drive each of a plurality of pipe sections in its longitudinal direction into the ground, support means for supporting the rams and means for transmitting force from the rams to the end of the pipe section to be driven. The support means is disposed at least partly within the pipe section during operation of the apparatus.

Further according to the present invention there is provided a method of driving pipe sections into the ground to form a pipe line. The method comprises installing a pipe section ina drivable position and arranging support means carrying a plurality of rams into the pipe section so that the support means is engaged with the pipe section. The rams are extended so that they apply a driving thrust force between an abutment and the support means thereby driving the pipe section longitudinally. The rams are then retracted so that they lie substantially within the pipe section to permit a further pipe section to be installed adjacent the first driven pipe section. The support means are disengaged from the first pipe section. Support means and rams are then moved in a reverse direction to the driving section to locate the latter in a further pipe section.

Preferably the support means has spaces therein, for example formed by tubular or hollow components, which receive the cylinders of the rams so that the rams can be disposed, when retracted, substantially entirely within the pipe section.

In known manner, the pipe sections are installed one by one in a trench and are driven into a wall of the trench. The length of the trench in the driving direction need not be much greater than the length of each pipe section since the support means and the rams are located substantially within the pipe section when the latter is driven through the wall of the trench into the ground. Also the width of the trench, transverse to the driving direction may also be comparatively small.

As is evident, the combination of the elements constituting the pipe-driving apparatus has a size effect to be installable into the open trench. Consequently, re-location of the apparatus to drive a fresh pipe section is easy to accomplish fairly rapidly. The piston rods of the rams would usually bear on abutment means in the trench opposite the pipe section and preferably the piston rods are provided with thrust blocks which engage on the abutment means.

To provide some flexiblity between the rams and tubular components accommodating their cylinders these parts may be interconnected by ball-and-socket type joints.

The support means may esentially be composed of an annular body carrying the aforementioned tubular components and a plurality of location members selectively engageable with the end of the pipe section to be driven. The location members can conveniently be swivelled radially inwards and outwards of the pipe section to effect disengagement and engagement with the end thereof. To this end the members may be pivoted to the support body and coupled to piston and cylinder units which effect this movement. Each location member may have an arcuate-shaped jaw which serves to contact the end of the pipe section over an arcuate length which subtends at least 30°, and preferably 45°, in relation to the axis of the pipe section.

It is preferable to arrange the rams and location members, of which there may be four of each, in a symmetrical manner in relation to the support body so that the rams and the location members are respectively offset by 90° from one another with each location member located between two of the rams.

The support means and part of the rams being located in the pipe section to be driven are protected thereby and indeed the apparatus can be operated from within the pipe section. To this end the support means may carry valve devices for actuating the rams and the location members.

After a pipe section has been fully driven into the ground the location members would be disengaged and the support means with the rams moved outwardly of the pipe section to re-engage on a fresh pipe section. To facilitate the movement of the support means along the pipe section it is desirable to provide the latter with rollers on its exterior which roll along the interior of the pipe section.

From time to time it is possible that a deformed pipe section of non-circular cross-section may appear. In this case it may be desirable for the support means to have expandible devices engageable on the inside of the pipe section and operated by mechanical or hydraulic means to restore the cross-section of the pipe section to the circular state.

The invention may be understood more readily and various other features of the invention may become apparent from consideration of the following description.

BRIEF DESCRIPTION OF DRAWINGS

An embodiment of the invention will now be described by way of example only, with reference to the accompanying drawings, wherein.

DESCRIPTION OF PREFERRED EMBODIMENTS

Figure 1A:
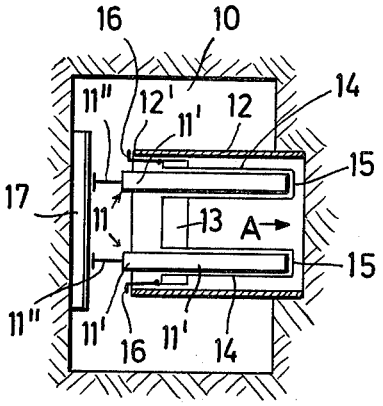
FIGS. 1*a* to 1*d* are diagrammatic plan view representations of an apparatus made in accordance with the invention showing successive stages during an operating cycle of the apparatus.

Referring initially to FIGS. 1*a* to 1*d* there is shown an open trench 10 from which pipe sections 12 are to be driven into the ground in the direction of the arrow A. In known manner a plurality of such pipe sections 12 are driven into the ground in succession to form a continuous pipe line composed of the pipe sections arranged end to end. The length of the trench 10 in the direction of arrow A need not be substantially greater than the length of the individual pipe sections 12. The driving of the pipe sections 12 into the ground is effected by means of an apparatus provided with a plurality of hydraulic piston and cylinder units or rams 11.

The apparatus is also provided with support means in the form of a body 13 having axially-directed reception spaces 14 which are located within the endmost pipe section 12 to be driven. The spaces 14 of the body 13 extend parallel to the axis of the pipe section 12 and serve to locate the cylinders 11' of the rams 11 and these cylinders 11' preferably engage the inner end walls 15 of the spaces 14 via flexible joints. The body 13 is provided with a series of adjustable location members 16 which can be made to selectively engage the outer end 12' of the pipe section 12 to thereby drivably connect the body 13 to the pipe section 12. The members 16 can be moved to selectively engage the pipe section 12 or to become disengaged therefrom with the aid of further hydraulic piston and cylinder units (not shown). The rams 11 have piston rods 11'' which can engage on abutment means 17 in the form of a frame, a plate, or a ring, for example, which is disposed at the side of the trench 10 opposite the pipe line.

Figure 1B:
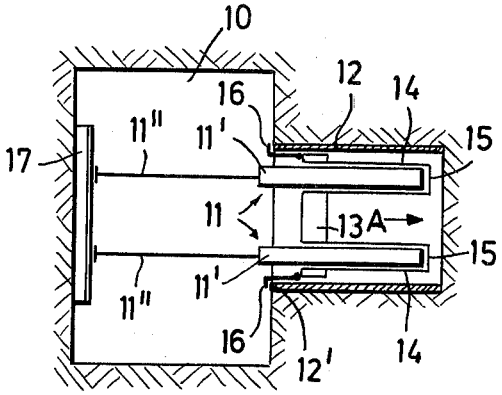

FIGS. 1*a* to 1*d* show successive stages in the pipe driving operation. Thus in FIG. 1*a* the pipe section 12 is installed in position and partly pushed into the ground with the members 16 engged on the outer end 12 of the pipe section 12. The cylinders 11' of the rams 11 are located within the spaces 14 in the body 13 and the piston rods 11'' are engaged on the abutment means 17. The rams 11 are then actuated by the admission of pressure fluid to extend and thereby as shown in FIG. 1*b* the force of the rams 11 is transmitted via the body 13 and the members 16 to the pipe section 12 to urge the latter in the direction of arrow A. When the rams 11 have extended to their maximum stroke, as represented in FIG. 1*b*, the pipe section 12 is fully driven in since the maximum stroke of the rams 11 is made equal to or greater than the length of the pipe section 12.

Figure 1C:
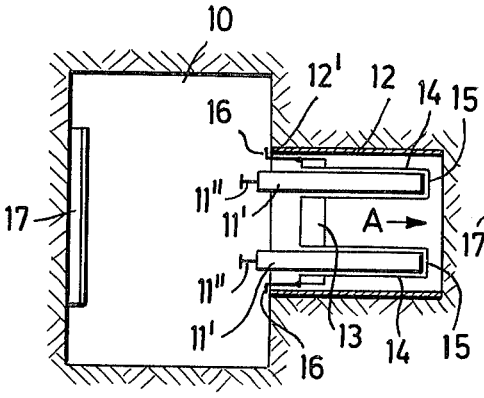
Figure 1D:
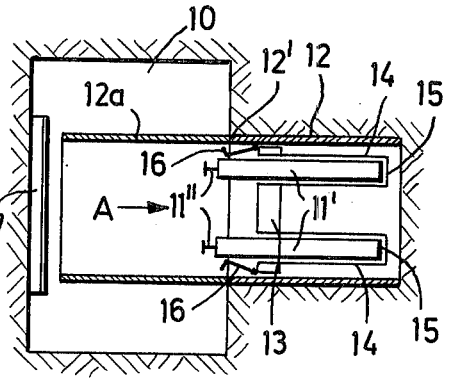

The next stage in the operating cycle is to retract the rams 11 while maintaining the cylinders 11' thereof in position. In this way the piston rods 11'' of the rams 11 retract into the cylinders 11' as shown in FIG. 1*c*. Thereafter, the members 16 are disengaged from the pipe section 12 by being swivelled radially inwards, FIG. 1*d*, so that a fresh pipe section **12*a* can be installed. The installation of the pipe section 12*a* may be assisted by means of a windlass or winch or the like. The body 13 and the rams 11 are now withdrawn in the direction opposite to arrow A so that the members 16 can be engaged with the end of the new pipe section 12*a*** and the apparatus can adopt the position shown in FIG. 1*a* to commence the cycle of operations again. The movement of the body 13 and the rams 11 may also be effected with the aid of the aforementioned windlass or winch. The material which is located within the pipe section would be removed manually or by some mechanical means which forms no part of the present invention.

Figure 2:
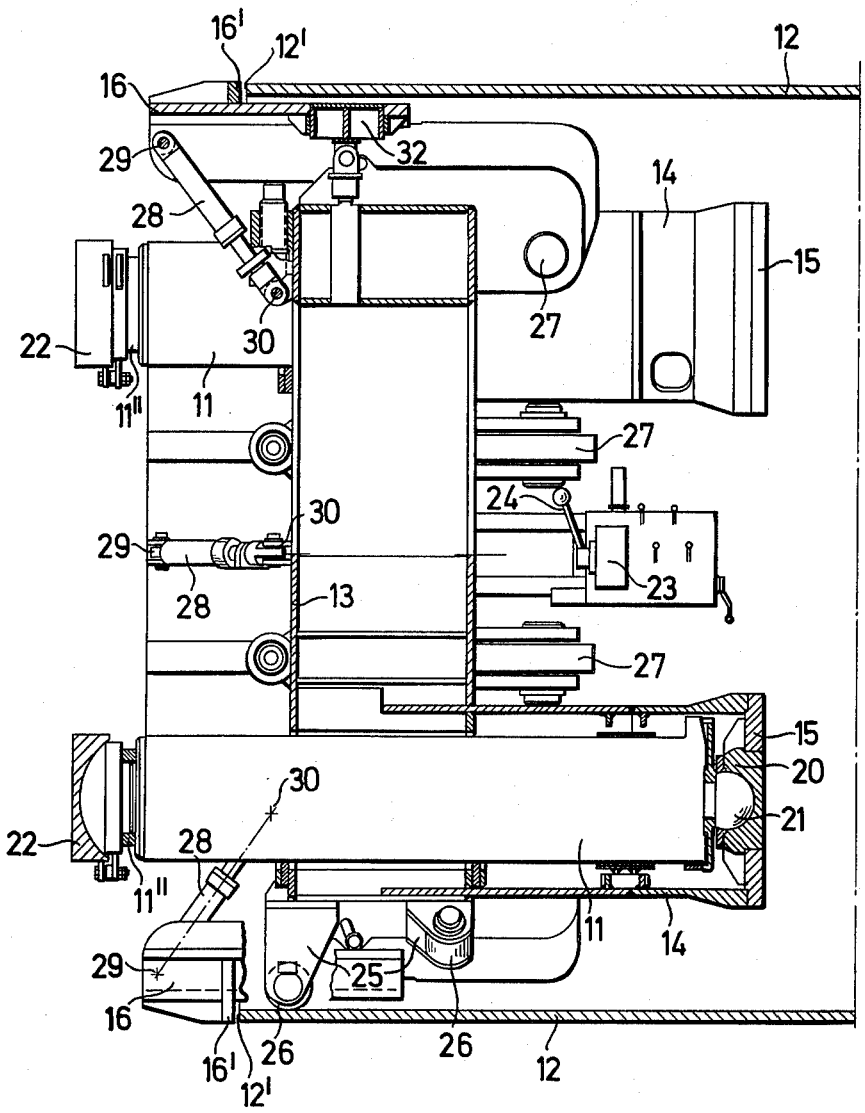
FIG. 2 is a sectional side view of a constructional embodiment of the apparatus.
Figure 3:
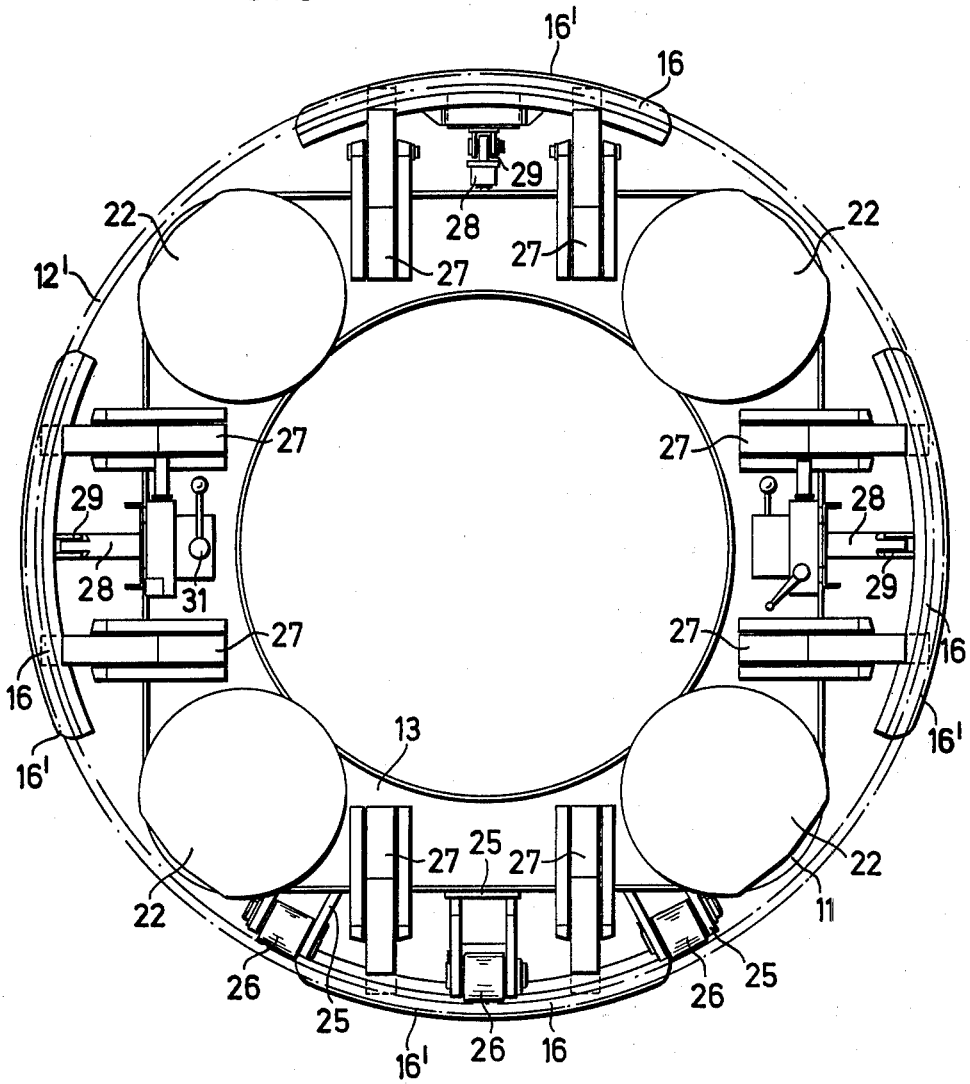
FIG. 3 is an end view of the apparatus shown in FIG. 2.

FIGS. 2 and 3 depict a constructional form of apparatus which operates in the manner described and for convenience the same reference numerals are used throughout the drawings to signify the same parts. As shown in FIGS. 2 and 3 four rams 11 are employed and these are disposed symmetrically about the axis of the pipe section 12 and the center of the body 13 with the rams 11 being mutually offset by 90° in relation to one another. The body 13 is of double-walled annular configuration and supports four tubular components 14 defining the spaces shown in FIGS. 1*a* to 1*d* for accommodating the cylinders of the rams 11. These tubular components 14 each have an end wall 15 which has a socket part 20 receiving a spherical piece 21 carried by the cylinder of the associated ram 11. The ball and socket joints thus formed enable the cylinder of each of the rams 11 to be displaced to a limited extent angularly of the axis of the associated tubular component 14. As shown in FIG. 2 the inside of each of the components 14 has a guideway which slidably receives one or more guide pieces carried by the cylinder of the associated ram 11 so that the latter is slidably guided for rotation within the component 14. The piston rods 11'' of the rams 11 are each coupled to a thrust block 22, preferably in a pivotable manner, and these blocks 22 serve to bear on the abutment means 17 (not shown in FIGS. 2 and 3).

The body 13 supports four locating members 16 which are pivotably connected to the body by means of mounting structures or bearings 27. The members 16 are symmetrically disposed between the rams 11 (FIG. 3) with the members 16 mutually offset from one another by 90°. The members 16 are swivelled radially inwards and outwards of the body 13 by means of hydraulic piston and cylinder units 28. Each of these units 28 has its cylinder pivotably connected by means of a pin 29 to the associated member 16 and its piston rod pivotably connected by means of a pin 30 to the body 13. Each member 16 has a jaw 16' of arcuate or segmental form with a radius of curvature corresponding to the radius of the pipe section 12. The arcuate length of each of the jaws 16' is such that the ends of the jaw 16' is brought into engagement with the end 12' of the pipe section 12 and it contacts the end 12' over a substantial area.

A valve device 23 is carried by the body 13 and is operated by means of a lever 24 to cause pressure fluid to charge the rams 11 when desired. Further valve devices 31 are also carried by the body 13 and serve to actuate the units 28 to swivel the members 16. A plurality of frame units 25 are provided on the exterior of the body 13 and these units 25 support rotatable rollers 26 which are designed to contact and roll along the inside of the pipe section 12. In this way the entire apparatus can be moved easily in relation to the pipe section 12 and this is especially desirable in moving the apparatus between the positions shown in FIGS. 1*d* and 1*a*. The body 13 is also provided with expanding devices 32, operated mechanically via spindles or the like or hydraulically. These devices 32 are arranged to bear on the inside of the pipe section 12 to restore the latter to a circular cross-section if the latter is deformed.

The apparatus is operated in the manner described in connection with FIGS. 1*a* to 1*d*.

I claim:

1. In a pipe-driving apparatus having a plurality of hydraulic rams for driving a pipe section in its longitudinal direction into the ground, the combination comprising:

a. means for supporting the rams at least partly within a pipe section to be driven, and b. means for transmitting thrust force from the rams to said pipe section, c. said support means having an annular body including a series of tubular components defining spaces for receiving the rams so that the rams can be disposed in an operating position substantially entirely within the pipe section, d. said spaces being effective to receive the cylinders of the rams, e. said support means having a plurality of location members pivotally connected to the annular support body and being movable into an operative position engaging the outer end of the pipe section to thereby transmit the force from the rams to the pipe section, f. each location member has an arcuate-shaped jaw which serves to contact the end of the pipe section over an arcuate length which subtends at least 30° in relation to the axis of the pipe section.

2. An apparatus as defined in claim 1 wherein the rams and location members are symmetrically disposed in relation to the annular support body and each location member is disposed between two of the rams.

3. In a pipe-driving apparatus installable into an open trench which comprises a plurality of hydraulic rams which serve to drive each of a plurality of pipe sections in its longitudinal direction into the ground through the wall of the trench; the improvement comprising:

a. means for supporting the rams at least partly within a pipe section to be driven, and b. means for transmitting thrust force from the rams to the end of said pipe section remote from the wall to urge said pipe section longitudinally into the ground through said wall.

c. said supporting means including expandable means for restoring the circular cross-section of the pipe section.

* * * * *